US007887368B1

(12) United States Patent
Rossman et al.

(10) Patent No.: US 7,887,368 B1
(45) Date of Patent: Feb. 15, 2011

(54) ELECTRICAL CONNECTOR HAVING A DIELECTRIC INSERT FOR RETAINING AN ELECTRICAL CONTACT

(75) Inventors: Jared Evan Rossman, Camp Hill, PA (US); Steven Lee Fickinger, Hummelstown, PA (US); Phillip Clay Brandberg, Carisle, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/510,904

(22) Filed: Jul. 28, 2009

(51) Int. Cl.
*H01R 11/00* (2006.01)

(52) U.S. Cl. ..... 439/595

(58) Field of Classification Search ..... 439/595, 439/752

See application file for complete search history.

(56) References Cited

U.S. PATENT DOCUMENTS

| | | | | | |
|---|---|---|---|---|---|
| 3,090,937 | A | | 5/1963 | Keith et al. | |
| 3,165,369 | A | * | 1/1965 | Maston | 439/380 |
| 4,019,799 | A | * | 4/1977 | Bouvier | 439/595 |
| 4,082,398 | A | * | 4/1978 | Bourdon et al. | 439/595 |
| 4,187,272 | A | | 2/1980 | Bourdon et al. | |
| 4,241,967 | A | * | 12/1980 | Collins | 439/589 |
| 4,274,702 | A | * | 6/1981 | Buck et al. | 439/589 |
| 4,358,179 | A | * | 11/1982 | Bourdon et al. | 439/595 |
| 4,386,816 | A | * | 6/1983 | Frear et al. | 439/595 |
| 4,387,944 | A | * | 6/1983 | Frear | 439/595 |
| 4,394,058 | A | * | 7/1983 | Frear | 439/595 |
| 4,406,507 | A | * | 9/1983 | Eifler | 439/595 |
| 4,636,020 | A | * | 1/1987 | Marmillion | 439/595 |
| 5,571,032 | A | | 11/1996 | Sano et al. | |
| 6,475,037 | B1 | | 11/2002 | Harting et al. | |
| 2002/0076995 | A1 | * | 6/2002 | Kurimoto et al. | 439/752 |
| 2005/0090156 | A1 | * | 4/2005 | Majima | 439/752 |

FOREIGN PATENT DOCUMENTS

| | | |
|---|---|---|
| EP | 2 003 737 | 12/2008 |
| FR | 2 508 728 | 12/1982 |

OTHER PUBLICATIONS

Customer Information Sheet—Revisions, Contact, Socket, Size ¼" with #4 AWG Crimp Barrel, Single CRN Rapid Lock, Tyco Part No. 6648434-1, Drawn: Aug. 30, 2005, Tyco Electronics Corporation, Menlo Park, CA, (1) page.

European Search Report, International Application No. EP 10 17 0784.

* cited by examiner

*Primary Examiner*—Gary F. Paumen

(57) ABSTRACT

An electrical connector includes a housing having a mating interface and an interior chamber, an electrical contact having a terminating segment and a mating segment, and a dielectric insert held within the interior chamber of the housing. The dielectric insert includes a contact channel and a resilient finger extending into the contact channel. The terminating segment of the electrical contact extends within the contact channel of the dielectric insert. The resilient finger is engaged with the terminating segment of the electrical contact to retain the electrical contact within the interior chamber of the housing such that the mating segment of the electrical contact extends along the mating interface of the housing.

16 Claims, 4 Drawing Sheets

ELECTRICAL CONNECTOR HAVING A DIELECTRIC INSERT FOR RETAINING AN ELECTRICAL CONTACT

BACKGROUND OF THE INVENTION

The subject matter herein relates generally to electrical connectors, and more particularly, to a dielectric insert for retaining an electrical contact within the housing of an electrical connector.

Electrical connectors are used to electrically connect a wide variety of electrical components. For example, electrical drawer connectors are used to connect various workstations and other electrical components to wide-area network (WAN) and local-area network (LAN) servers. Drawer connectors typically include a housing that holds a plurality of electrical contacts having terminating segments that terminate electrical wires and/or electrical cables that extend from the server. The electrical contacts include mating segments that extend along a mating interface of the housing of the drawer connector. The housing can be mated with the mating connector of an electrical component at the mating interface to electrically connect the electrical component to the server.

The terminating segments of the electrical contacts of drawer connectors are sometimes held within a mounting cavity of the housing a dielectric insert and a metal retention clip. Specifically, the dielectric insert is first loaded into the mounting cavity of the housing. Thereafter, the metal retention clip is hand-loaded into a contact channel that extends through the dielectric insert, such that the dielectric insert extends around the metal retention clip. The electrical contact is then inserted into an opening within the metal retention clip such that the metal retention clip extends around the terminating segment of the electrical contact. The metal retention clip includes a plurality of fingers that extend radially inwardly and engage the terminating segment of the electrical contact to retain the electrical contact within the mounting cavity of the housing. Using the metal retention clip to retain the electrical contact within the mounting cavity is not without disadvantages. For example, the metal retention clip may increase a complexity and/or a number of components of the drawer connector, which may increase a cost of the drawer connector. Moreover, it may be difficult and/or time-consuming to separately load each of the dielectric insert, the metal retention clip, and the electrical contact within the mating cavity of the housing. The metal retention clip may therefore increase a cost, difficulty, and/or time of assembling the drawer connector.

BRIEF DESCRIPTION OF THE INVENTION

In one embodiment, an electrical connector includes a housing having a mating interface and an interior chamber, an electrical contact having a terminating segment and a mating segment, and a dielectric insert held within the interior chamber of the housing. The dielectric insert includes a contact channel and a resilient finger extending into the contact channel. The terminating segment of the electrical contact extends within the contact channel of the dielectric insert. The resilient finger is engaged with the terminating segment of the electrical contact to retain the electrical contact within the interior chamber of the housing such that the mating segment of the electrical contact extends along the mating interface of the housing.

In another embodiment, an electrical connector includes a housing having a mating interface and an interior chamber, an electrical contact having a terminating segment and a mating segment, and a dielectric insert held within the interior chamber of the housing. The dielectric insert includes a base having a contact channel extending therethrough and resilient fingers extending from the base into the contact channel. The terminating segment of the electrical contact extends within the contact channel of the dielectric insert. The resilient fingers are spaced apart around a periphery of the terminating segment of the electrical contact. The resilient fingers include free ends that are engaged with the terminating segment of the electrical contact to retain the electrical contact within the interior chamber of the housing such that the mating segment of the electrical contact extends along the mating interface of the housing.

DETAILED DESCRIPTION OF THE INVENTION

Figure 1:
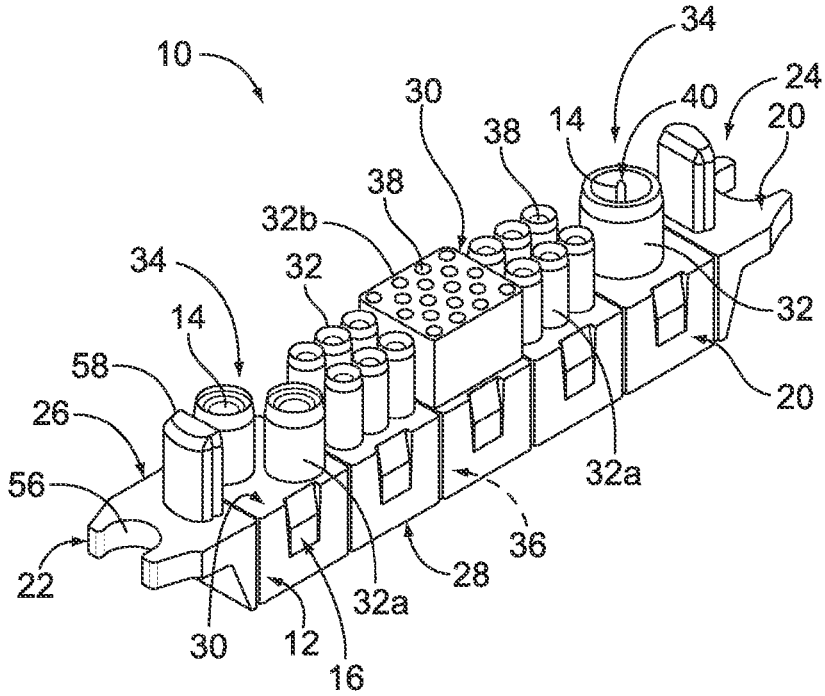
FIG. 1 is a perspective view of an exemplary embodiment of an electrical connector.

FIG. 1 is a perspective view of an exemplary embodiment of an electrical connector 10. The electrical connector 10 includes a housing 12 that holds a plurality of electrical contacts 14. Only some of the electrical contacts 14 are visible in FIG. 1. The electrical contacts 14 held by the housing 12 may include signal contacts, ground contacts, and/or power contacts. More specifically, each electrical contact 14 that is held by the housing 12 may transmit electrical data signals, electrical ground, or electrical power. The electrical connector 10 may be used, for example, as a drawer connector for network servers (not shown) and/or the like. However, the subject matter described and/or illustrated herein is not limited to drawer connectors. Rather, the subject matter described and/or illustrated herein may be used as, and/or with, any type of electrical connector for electrically connecting any electrical components together. As will be descried below, the electrical contacts 14 are held by the housing 12 using dielectric inserts 16 having resilient fingers 62 (FIGS. 3-6) that engage the electrical contacts 14.

The housing 12 includes a base 20 that extends a length from an end 22 to an opposite end 24. The housing base 20 includes a mating side 26 that extends from the end 22 to the end 24, and a terminating side 28 that extends from the end 22 to the end 24. In the exemplary embodiment, the terminating side 28 is opposite the mating side 26. Alternatively, the mating side 26 and the terminating side 28 intersect. The mating side 26 defines a portion of a mating interface 30 at which the electrical connector 10 is configured to be mated with a mating connector (not shown). When mated with the mating connector, each of the electrical contacts 14 of the electrical connector 10 is engaged with, and thereby electrically connected to, one or more corresponding electrical contacts (not shown) of the mating connector. An electrical connection between the electrical connector 10 and the mating connector can thereby be established by mating the electrical connector 10 and the mating connector together at the mating interface 30.

Figure 2:
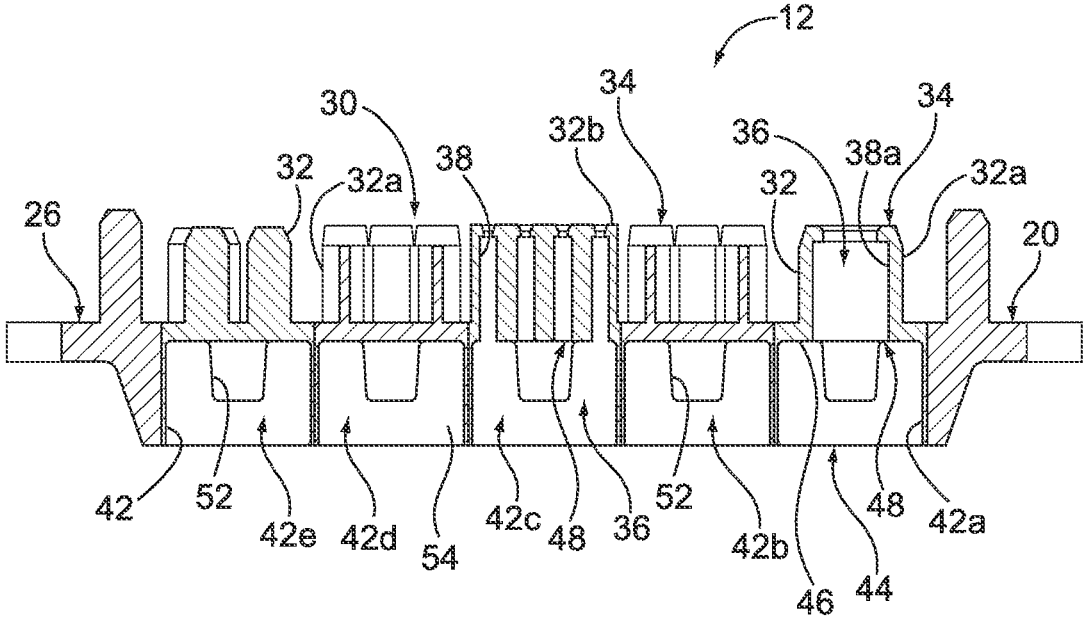
FIG. 2 is a cross-sectional of an exemplary embodiment of a housing of the electrical connector shown in FIG. 1.

FIG. 2 is a cross-sectional view of an exemplary embodiment of the housing 12. Referring now to FIGS. 1 and 2, in addition to the mating side 26 of the housing base 20, in the exemplary embodiment the mating interface 30 is defined by a plurality of contact extensions 32 that extend outwardly from the mating side 26 of the housing base 20. Each contact extension 32 extends a length from the mating side 26 of the housing base 20 to a free end 34. The housing 12 includes an interior chamber 36 within which the electrical contacts 14 (FIGS. 1 and 6) are held. Each contact extension 32 includes one or more mating cavities 38 that extend through the length of the contact extension 32. The mating cavities 38 define a portion of the interior chamber 36 of the housing 12. As will be described below, each mating cavity 38 holds a mating segment 40 (not shown in FIG. 2) of one or more of the electrical contacts 14 therein.

In the exemplary embodiment, the contact extensions 32 include a plurality of contact barrels 32*a* and a contact block 32*b*. Each contact barrel 32*a* includes a cylindrically shaped body that includes a single one of the mating cavities 38 extending therethrough. The contact block 32*b* includes a rectangular shaped body that includes a plurality of the mating cavities 38 extending therethrough. Although sixteen are shown, the housing 12 may include any number of the contact extensions 32, including any number of the contact barrels 32*a* and any number of the contact blocks 32*b*. Moreover, each contact extension 32 may include any number of the mating cavities 38 for holding any number of the electrical contacts 14. In addition or alternative to the cylindrical and rectangular shapes shown herein, each contact extension 32 may include any other shape.

As best seen in FIG. 2, the terminating side 28 of the housing base 20 includes a plurality of mounting cavities 42 extending therein. The mounting cavities 42 define a portion of the interior chamber 36 of the housing 12. Each mounting cavity 42 extends into the housing base 20 from an open end 44 to a bottom 46. Each mounting cavity 42 is aligned along the length of the housing base 20 with one or more corresponding ones of the contact extensions 32. Accordingly, each mounting cavity 42 is aligned with one or more corresponding mating cavities 38 of the contact extensions 32. One or more openings 48 extend through the bottom 46 of each of the mounting cavities 42 such that each mating cavity 38 fluidly communicates with the corresponding mounting cavity 42 with which the mating cavity 38 is aligned. As will be described below, each mounting cavity 42 holds a corresponding one of the dielectric inserts 16 (FIGS. 1 and 3-6) therein. The dielectric inserts 16 hold terminating segments 50 (FIG. 6) of one or more of the electrical contacts 14 such that the mating segment 40 (FIGS. 1 and 6) of the electrical contact 14 extends within the corresponding mating cavity 38. Although five are shown, the terminating side 28 of the housing base 20 may include any number of the mounting cavities 42, each of which may hold any number of the dielectric inserts 16 and any number of the electrical contacts 14. Although shown as including a rectangular shape, each mounting cavity 42 may additionally or alternatively include any other shape.

The housing base 20 includes a plurality of optional latch openings 52 for latching the dielectric inserts 16 within the mounting cavities 42. The latch openings 52 extend through walls 54 of the housing base 20 that define the mounting cavities 42. In addition or alternatively to the latch openings 52, the housing base 20 may include any other type of latch element for latching the dielectric inserts 16 within the mounting cavities 42, such as, but not limited to, extensions, arms, shoulders, tabs, an interference (or clearance) fit, and/or the like. The housing base 20 may include any number of the latch openings 52. Each latch opening 52 may be referred to herein as a "latch feature".

Referring again to FIG. 1, the housing base 20 optionally includes one or more mounting features 56 for mounting the housing 12 on a structure, such as, but not limited to, a panel, a housing, a wall, a rack, and/or the like. Although two are shown, the housing base 20 may include any number of the mounting features 56. In the exemplary embodiment, each mounting feature 56 is located at a corresponding one of the ends 22 and 24 of the housing base 20. However, the housing base 20 may additionally or alternatively include one or more mounting features 56 at any other location along the length of the housing base 20 than the ends 22 and/or 24. Moreover, although shown as openings, each mounting feature 56 may additionally or alternatively include any other structure, such as, but not limited to, extensions, clips, latches, arms, other types of fasteners, and/or the like.

Optionally, the housing base 20 includes one or more alignment extensions 58 for aligning the housing 12 with the mating connector during mating of the electrical connector 10 with the mating connector. In the exemplary embodiment, each of the alignment extensions 58 extends outwardly from the mating side 26 of the housing base 20 adjacent a corresponding one of the ends 22 and 24 of the housing base 20. The alignment extensions 58 are each received within a corresponding alignment opening (not shown) of the mating connector during mating therewith. In addition or alternative to the alignment extensions 58, the housing base 20 may include one or more alignment openings (not shown) that receives an alignment extension (not shown) of the mating connector therein. The housing base 20 may include any number of the alignment extensions 58. In the exemplary embodiment, the housing base 20 includes two alignment extensions 58. Each of the alignment extensions 58 may alternatively be located at any other location along the length of the housing base 20 than adjacent the ends 22 and/or 24.

Figure 3:
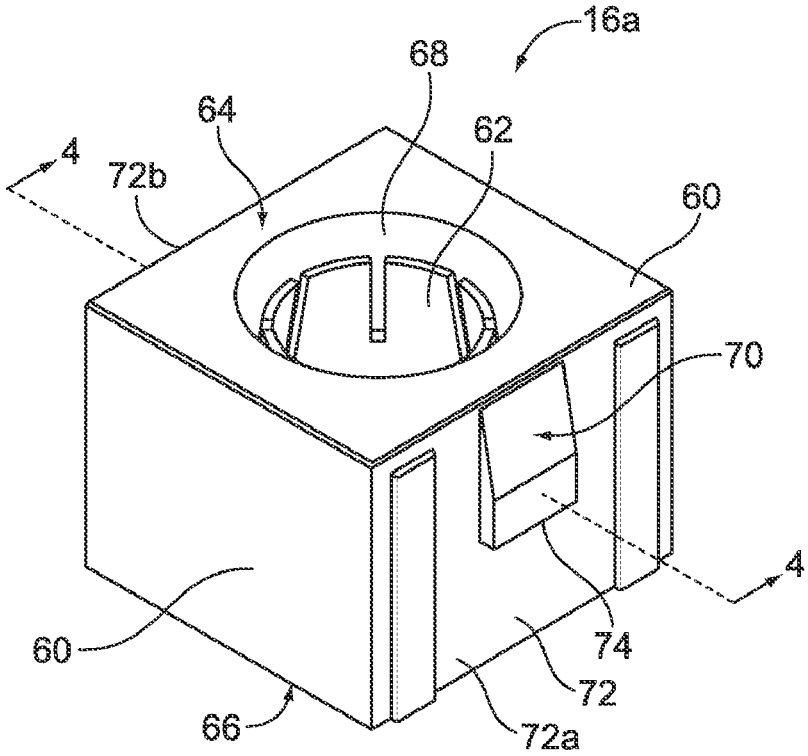
FIG. 3 is a perspective view of an exemplary embodiment of a dielectric insert of the electrical connector shown in FIG. 1.
Figure 4:
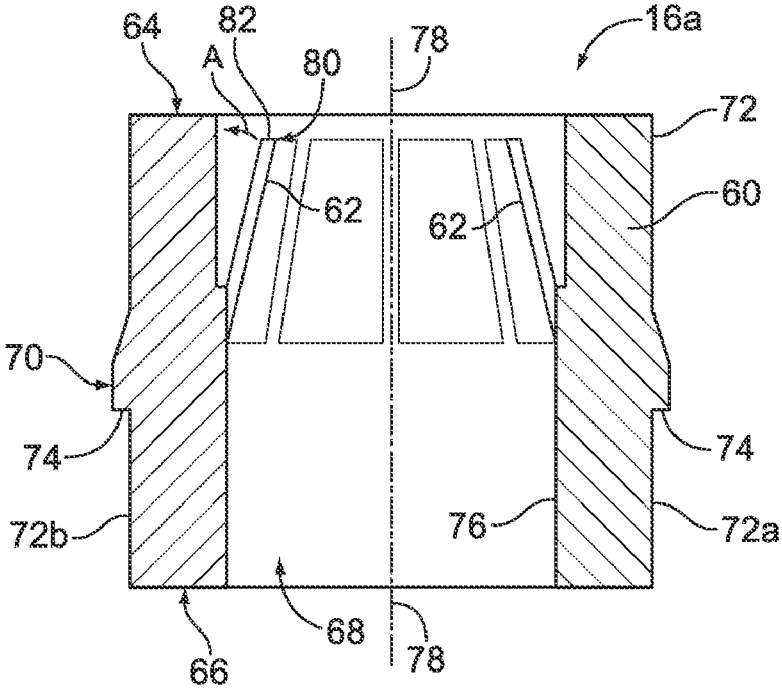
FIG. 4 is a cross-sectional view of the dielectric insert shown in FIG. 3 taken along line 4-4 of FIG. 3.
Figure 6:
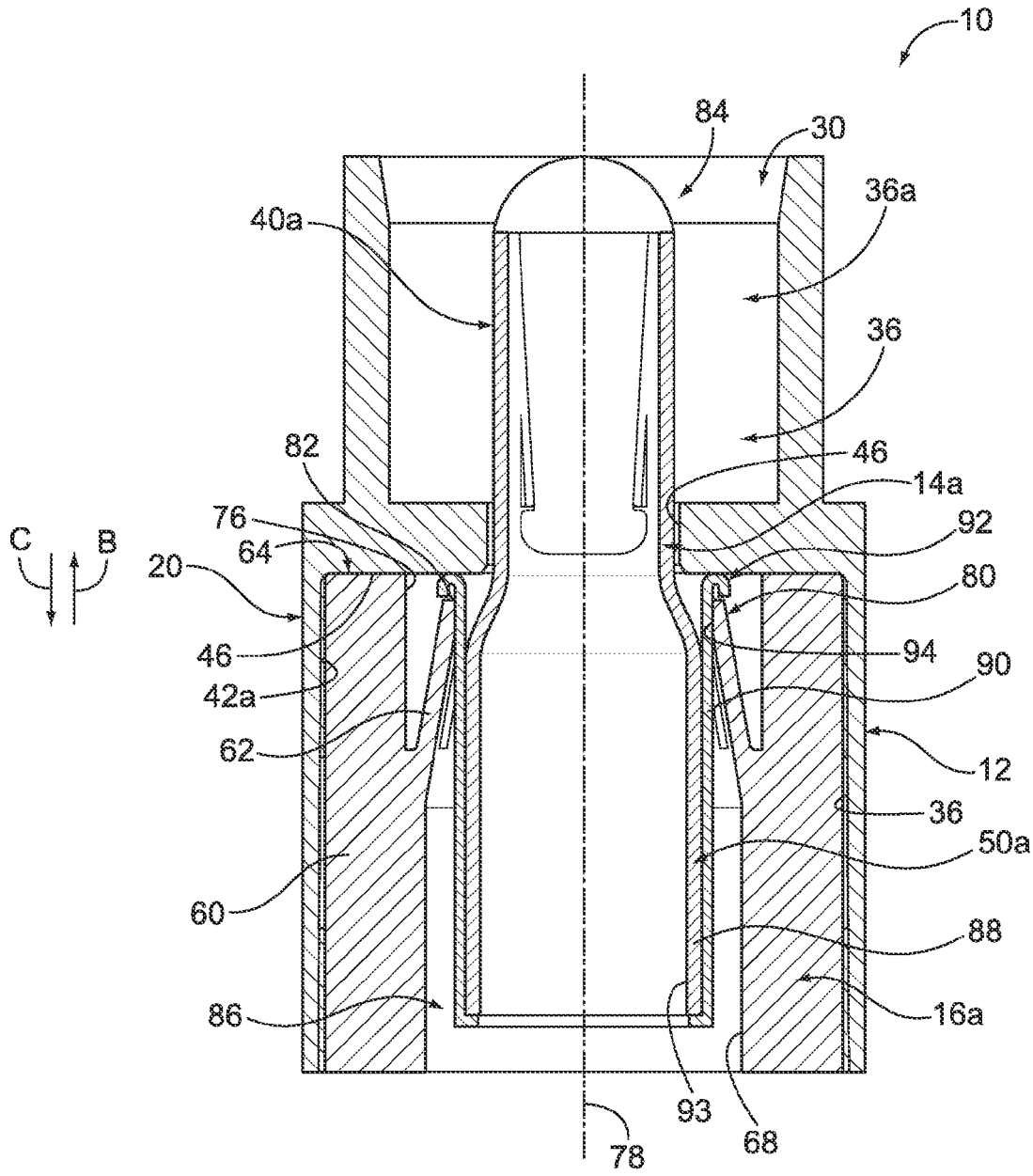
FIG. 6 is a cross-sectional view of a portion of the electrical connector shown in FIG. 1 illustrating the dielectric insert shown in FIG. 3 retaining an exemplary embodiment of an electrical contact within the housing shown in FIG. 2.

FIG. 3 is a perspective view of an exemplary embodiment of one of the dielectric inserts 16*a*. FIG. 4 is a cross-sectional view of the dielectric insert 16*a* taken along line 4-4 of FIG. 3. Referring now to FIGS. 3 and 4, the dielectric insert 16*a* is configured to be received within a corresponding one of the mounting cavities 42*a* (FIGS. 2 and 6). The dielectric insert 16*a* includes a base 60 and one or more resilient fingers 62 extending from the base 60. The base 60 extends a length from an end 64 to an opposite end 66. A contact channel 68 extends through the length of the base 60. Specifically, the contact channel 68 extends through the ends 64 and 66 and completely through the base 60 therebetween. The contact channel 68 is configured to hold the terminating segment 50 (FIG. 6) of a corresponding one of the electrical contacts 14 (FIGS. 1 and 6) therein. Although shown as cylindrical, the contact channel 68 may additionally or alternatively include any other shape.

The base 60 of the dielectric insert 16*a* is optionally shaped complementary to the mounting cavity 42*a* for reception therein. In the exemplary embodiment, the base 60 of the dielectric insert 16*a* includes a rectangular shape that is complementary to the rectangular shape of the mounting cavity 42*a*. However, the base 60 of the dielectric insert 16*a* may additionally or alternatively include any other shape for reception within a mounting cavity 42 having any shape. The base 60 includes one or more optional latch tabs 70 that cooperate with the latch openings 52 (FIG. 2) of the housing base 20 (FIGS. 1, 2, and 6) to latch the dielectric insert 16*a* within the mounting cavity 42*a*. Each latch tab 70 extends outwardly from a side 72 of the base 60 of the dielectric insert 16*a* and includes a shoulder 74. As the dielectric insert 16*a* is loaded into the mounting cavity 42*a*, the latch tabs 70 are each received within a corresponding one of the latch openings 52. The shoulders 74 engage surfaces of the wall 54 (FIG. 2) of the housing base 20 that define the latch openings 52 to latch the dielectric insert 16*a* within the mounting cavity 42*a*. In addition or alternatively to the latch tabs 70, the base 60 of the dielectric insert may include any other type of latch element for latching the dielectric insert 16*a* within the mounting cavity 42*a*, such as, but not limited to, openings and/or the like. In some embodiments, and in addition or alternative to the latch tabs 70, the dielectric insert 16*a* is held within the mounting cavity 42*a* via an interference, or clearance, fit between the base 60 and the housing 12. The base 60 of the dielectric insert 16*a* may include any number of the latch tabs 70. In the exemplary embodiment, the base 60 of the dielectric insert 16*a* includes two latch tabs 70 (only one is visible in FIG. 1) located on opposite sides 72*a* and 72*b* of the base 60. In addition or alternative to the sides 72*a* and 72*b*, the base 60 may include latch tabs 70 at any other locations thereon. Each of the latch tabs 70 may be referred to herein as a "latch element".

Referring now to FIG. 4, the base 60 of the dielectric insert 16*a* includes an interior surface 76 that defines the contact channel 68. The contact channel 68 extends a length through the base 60 along a central longitudinal axis 78. Each resilient finger 62 extends outwardly from the interior surface 76 of the base 60 into the contact channel 68. In other words, the resilient fingers 62 extend outwardly from the interior surface 76 of the base 60 radially inward relative to the central longitudinal axis 78 and along the length of the contact channel 68 toward the end 64 of the base 60. Each resilient finger 62 extends a length from the interior surface 76 of the base 60 to a tip 80. The tip 80 may also be referred to herein as a "free end". Each tip 80 includes an end surface 82. The tips 80 of the resilient fingers 62 are configured to engage the terminating segment 50 (FIG. 6) of a corresponding one of the electrical contacts 14 (FIGS. 1 and 6) to hold the electrical contact 14 within the contact channel 68. For example, the end surface 82 of each tip 80 engages the corresponding electrical contact 14.

The tips 80 of the resilient fingers 62 are biased to a locked position, which is shown in FIG. 4. In other words, the tips 80 are in the locked position when the resilient fingers 62 are in the natural, or undeformed, state thereof. Each tip 80 is movable from the locked position, and against the bias, radially outward relative to the central longitudinal axis 78 and toward the interior surface 76 of the base 60. Movement of the tips 80 radially outward relative to the central longitudinal axis 78 and toward the interior surface 76 of the base 60 is indicated in FIG. 4 by the arc A. As will be described below, in the locked position, the tips 80 of the resilient fingers 62 are engaged with the corresponding electrical contact 14.

Referring again to FIG. 3, the resilient fingers 62 are spaced apart from one another about a periphery of the contact channel 68. In other words, the resilient fingers 62 are spaced apart from each other about the interior surface 76 of the base 60 of the dielectric insert 16*a*. In the exemplary embodiment, each resilient finger 62 includes a rectangular shape; however, each resilient finger 62 may additionally or alternatively include any other shape. Moreover, although the end surfaces 82 of the tips 80 are shown herein as being approximately planar, the end surface 82 of each tip 80 may additionally or alternatively include any other shape. For example, in some alternative embodiments, the end surface 82 of one or more of the tips 80 includes a curved shape, a v-shape, and/or the like. In some embodiments, the end surface 82 or another portion of the one or more of the tips 80 may include a shape that is complementary to the shape of the portion of the electrical contact 14 that the tip 80 engages. Any number of the resilient fingers 62 may extend within the contact channel 68 of the dielectric insert 16*a*. In the exemplary embodiment, the dielectric insert 16*a* includes eight resilient fingers 62, only six of which are visible in FIG. 3.

Figure 5:
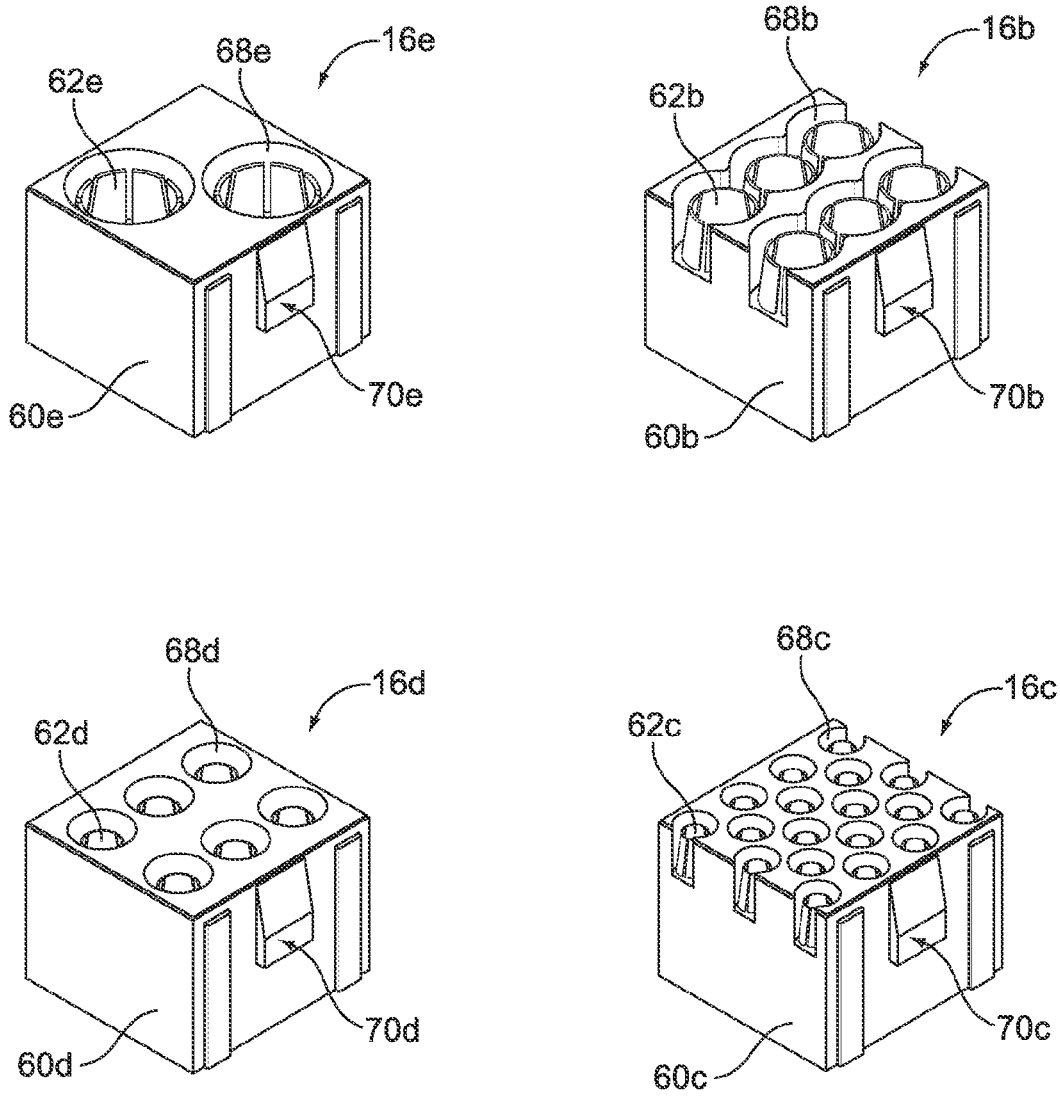
FIG. 5 is a perspective view of a plurality of exemplary embodiments of other dielectric inserts of the electrical connector 10 shown in FIG. 1.

Although shown and described as having only a single contact channel 68 for holding a single electrical contact 14, the dielectric insert 16*a* may include any number of contact channels 68 for holding any number of the electrical contacts 14. For example, FIG. 5 is a perspective view of a plurality of exemplary embodiments of other dielectric inserts 16*b*, 16*c*, 16*d*, and 16*e* of the electrical connector 10 (FIGS. 1 and 6). The dielectric inserts 16*b*, 16*c*, 16*d*, and 16*e* are configured to be received within mounting cavities 42*b*, 42*c*, 42*d*, and 42*e* (FIG. 2), respectively, of the housing 12 of the electrical connector 10. Each dielectric insert 16*b*, 16*c*, 16*d*, and 16*e* includes a plurality of respective contact channels 68*b*, 68*c*, 68*d*, and 68*e*. For example, the dielectric inserts 16*b* and 16*d* each include a respective base 60*b* and 60*d* having six respective contact channels 68*b* and 68*d* extending through the length thereof. Each contact channel 68*b* and 68*d* holds a corresponding one of the electrical contacts 14 (FIGS. 1 and 6) therein. Four resilient fingers 62*b* and 62*d* extend within each of the contact channels 68*b* and 68*d*, respectively, for holding the corresponding electrical contact 14 therein. Similar to the dielectric insert 16*a* (FIGS. 3, 4, and 6), the bases 60*b* and 60*d* of the respective dielectric inserts 16*b* and 16*d* include one or more optional latching tabs 70*b* and 70*d*, respectively, for latching the dielectric inserts 16*b* and 16*d* within the respective mounting cavities 42*b* and 42*d*.

The dielectric insert 16*c* includes a base 60*c* having eighteen contact channels 68*c* extending through the length thereof. Each contact channel 68*c* of the dielectric insert 16*c* holds a corresponding one of the electrical contacts 14 therein. Two resilient fingers 62*c* extend within each of the contact channels 68*c* for holding the corresponding electrical contact 14 therein. The base 60*c* of the dielectric insert 16*c* includes one or more optional latching tabs 70*c* for latching the dielectric insert 16*c* within the mounting cavity 42*c*.

Two contact channels 68*e* extend through the length of the base 60*e* of the dielectric insert 16*e*. The contact channels 68*e* of the dielectric insert 16*e* each hold a corresponding one of the electrical contacts 14 therein. Each contact channel 68*e* includes eight resilient fingers 62*e* for holding the corresponding electrical contact 14 therein. One or more optional latching tabs 70*e* are provided on the dielectric insert 16*e* for latching the dielectric insert 16*e* within the mounting cavity 42*e*.

FIG. 6 is a cross-sectional view of a portion of the electrical connector 10 illustrating the dielectric insert 16*a* retaining an exemplary embodiment of an electrical contact 14*a* within the housing 12. The electrical contact 14*a* includes a mating segment 40*a* and a terminating segment 50*a*. In the exemplary embodiment, the mating and terminating segments 40*a* and 50*a*, respectively, define respective ends 84 and 86 of the electrical contact 14*a*. Alternatively, the mating segment 40*a* and/or the terminating segment 50*a* are located along other portions of the electrical contact 14*a* besides the ends 84 and 86, respectively. In the exemplary embodiment, the mating segment 40*a* of the electrical contact 14*a* is a pin that is configured to be received within a receptacle (not shown) of the corresponding electrical contact (not shown) of the mating connector (not shown). However, the mating segment 40*a* of the electrical contact 14*a* may alternatively include any other type of contact structure, such as, but not limited to, a receptacle (not shown) that is configured to receive a portion of the corresponding electrical contact of the mating connector therein, and/or the like.

In the exemplary embodiment, the terminating segment 50*a* of the electrical contact 14*a* includes an inner shell 88 and a sleeve 90 extending at least partially around the inner shell 88. The sleeve 90 includes a shoulder 92. In some alternative embodiments, the terminating segment 50*a* of the electrical contact 14*a* does not include the sleeve 90. In such embodiments wherein the terminating segment 50*a* does not include the sleeve 90, the inner shell 88 (which may be referred to as a "shell") includes a shoulder (not shown), which is optionally formed integrally therewith. The inner shell 88 of the terminating segment 50*a* includes an opening 93 for receiving an electrical conductor (not shown), for example an electrical conductor of an electrical cable (not shown) and/or an electrical wire (not shown). The inner shell 88 is crimped about the electrical conductor to mechanically connect the electrical conductor to the terminating segment 50*a* as well as establish an electrical connection therebetween. The terminating segment 50*a* is thereby configured to terminate the electrical cable and/or electrical wire in the exemplary embodiment. Alternatively, the terminating segment 50*a* includes any other type of contact structure, such as, but not limited to, a surface mount structure, a press-fit structure, a pin, and/or the like, for example, for electrically connecting the terminating segment 50*a* to a circuit board (not shown).

The base 60 of the dielectric insert 16*a* is received within the mounting cavity 42*a* of the housing base 20 such that the end 64 of the base 60 engages the bottom 46 of the mounting cavity 42*a*. Each latch tab 70 (FIGS. 3 and 4) of the dielectric insert 16*a* is received within the corresponding latch opening 52 (FIG. 2) of the mounting cavity 42*a* to hold the dielectric insert 16*a* within the mounting cavity 42*a*. The dielectric insert 16*a* is thereby held within the interior chamber 36 of the housing 12.

The electrical contact 14*a* is loaded into the contact channel 68 of the dielectric insert 16*a* in the direction of the arrow B. As the electrical contact 14*a* is loaded into the contact channel 68, the shoulder 92 of the sleeve 90 engages the resilient fingers 62 of the dielectric insert 16*a*. Engagement between the shoulder 92 and the resilient fingers 62 moves the tips 80 of the resilient fingers 62, against the bias thereof, radially outward relative to the central longitudinal axis 78 and toward the interior surface 76 of the base 60. The shoulder 92 thereby moves the tips 80 away from the locked position to enable the shoulder 92 to clear the tips 80. Once the shoulder 92 has passed the tips 80, the bias of the resilient fingers 62 moves the tips 80 back to the locked position, wherein the tips 80 engage the terminating segment 50*a* of the electrical contact 14*a*. Specifically, the end surfaces 82 of the tips 80 engage the shoulder 92 of the sleeve 90, while radially inner surfaces 94 of the tips 80 engage the sleeve 90 adjacent the shoulder 92. The resilient fingers 62 of the dielectric insert 16*a* thereby retain the electrical contact 14*a* within the interior chamber 36 of the housing 12. When retained in the interior chamber 36 of the housing 12, the terminating segment 50*a* of the electrical contact 14*a* extends within the contact channel 68 of the dielectric insert 16*a* and within the mounting cavity 42*a* of the housing base 20. The mating segment 40*a* of the electrical contact 14*a* extends through the opening 48 within the bottom 46 of the mating cavity 42*a* into the corresponding mating cavity 36*a* of the housing 12. The mating segment 40*a* of the electrical contact 14*a* thereby extends along the mating interface 30 of the housing 12.

To remove the electrical contact 14*a* from the interior chamber 36 of the housing 12, a tool (not shown) can be inserted into the contact channel 68 of the dielectric insert 16*a* within the space between the sleeve 90 and the interior surface 76 of the dielectric insert 16*a*. The tool engages the tips 80 of the resilient fingers 62 to move the tips 80, against the bias thereof, radially outward relative to the central longitudinal axis 78 and toward the interior surface 76. Once the tips 80 are moved radially outwardly past the shoulder 92 of the sleeve 90, the electrical contact 14*a* can be removed from the contact channel 68 of the dielectric insert 16*a* in the direction of the arrow C.

The dielectric inserts 16*b*, 16*c*, 16*d*, and 16*e* (FIG. 5) retain the corresponding electrical contacts 14 within the interior chamber 36 of the housing 12 in a substantially similar manner to the dielectric insert 16*a*, which therefore will not be described or illustrating in more detail herein. It should be understood, however, the corresponding electrical contacts 14 retained by the dielectric inserts 16*b*, 16*c*, 16*d*, and 16*e* may be different types of contacts from the electrical contact 14*a* and/or from each other. For example, one or more of the electrical contacts retained by the dielectric inserts 16*b*, 16*c*, 16*d*, and/or 16*e* may have a mating segment 40 that includes a receptacle (not shown) that receives a portion of the corresponding electrical contact (not shown) of the mating connector (not shown).

The embodiments described and/or illustrated herein may provide an electrical connector that is less expensive, less complex and/or has fewer components than at least some known electrical connectors. The embodiments described and/or illustrated herein may provide an electrical connector that is less expensive to assemble, less difficult to assemble, and/or takes less time to assemble than at least some known electrical connectors.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector comprising:

a housing having a mating interface and an interior chamber;

an electrical contact comprising a terminating segment and a mating segment, the terminating segment of the electrical contact comprising an inner shell and a sleeve extending at least partially around the inner shell; and a dielectric insert held within the interior chamber of the housing, the dielectric insert comprising a contact channel and a resilient finger extending into the contact channel, the terminating segment of the electrical contact extending within the contact channel of the dielectric insert, the resilient finger being engaged with the sleeve of the terminating segment of the electrical contact to retain the electrical contact within the interior chamber of the housing such that the mating segment of the electrical contact extends along the mating interface of the housing.

2. The electrical connector according to claim 1, wherein the dielectric insert comprises a base, the resilient finger extending a length from the base to a tip, the tip of the resilient finger being engaged with the sleeve of the terminating segment of the electrical contact.

3. The electrical connector according to claim 1, wherein the dielectric insert comprises a base and the contact channel of the dielectric insert extends a length along a central longitudinal axis, the resilient finger of the dielectric insert extending from the base radially inward relative to the central longitudinal axis.

4. The electrical connector according to claim 1, wherein the dielectric insert comprises an interior surface that defines the contact channel, the resilient finger extending outwardly from the interior surface into the contact channel.

5. The electrical connector according to claim 1, wherein the sleeve comprises a shoulder, the resilient finger being engaged with the shoulder of the sleeve for retaining the electrical contact within the interior chamber of the housing.

6. The electrical connector according to claim 1, wherein the contact channel of the dielectric insert extends along a central longitudinal axis, the resilient finger comprises a tip having a locked position, the tip being movable from the locked position radially outward relative to the central longitudinal axis of the contact channel, the tip of the resilient finger being engaged with the sleeve of the terminating segment of the electrical contact when in the locked position.

7. The electrical connector according to claim 1, wherein the interior chamber of the housing comprises a mating cavity and a mounting cavity, the mounting cavity having a bottom, an opening extends through the bottom such that the mating and mounting cavities fluidly communicate with each other, the dielectric insert and the terminating segment of the electrical contact being held within the mounting cavity of the interior chamber, the mating segment of the electrical contact extending through the opening into the mating cavity of the interior chamber.

8. The electrical connector according to claim 1, wherein the dielectric insert comprises a latch element that cooperates with a latch feature of the housing to hold the dielectric insert within the interior chamber of the housing.

9. The electrical connector according to claim 1, wherein the terminating segment of the electrical contact comprises an end of the electrical contact.

10. The electrical connector according to claim 1, wherein the mating segment of the electrical contact comprises an end of the electrical contact.

11. An electrical connector comprising:

a housing having a mating interface and an interior chamber;

an electrical contact comprising a terminating segment and a mating segment, the terminating segment of the electrical contact comprising an inner shell and a sleeve extending at least partially around the inner shell; and a dielectric insert held within the interior chamber of the housing, the dielectric insert comprising a base having a contact channel extending therethrough and resilient fingers extending from the base into the contact channel, the terminating segment of the electrical contact extending within the contact channel of the dielectric insert, the resilient fingers being spaced apart around a periphery of the terminating segment of the electrical contact, the resilient fingers comprising free ends that are engaged with the sleeve of the terminating segment of the electrical contact to retain the electrical contact within the interior chamber of the housing such that the mating segment of the electrical contact extends along the mating interface of the housing.

12. The electrical connector according to claim 11, wherein the contact channel of the dielectric insert extends a length along a central longitudinal axis, the resilient fingers of the dielectric insert extending from the base radially inward relative to the central longitudinal axis.

13. The electrical connector according to claim 11, wherein the dielectric insert comprises an interior surface that defines the contact channel, the resilient fingers extending outwardly from the interior surface into the contact channel.

14. The electrical connector according to claim 11, wherein the sleeve comprises a shoulder, the resilient fingers being engaged with the shoulder of the sleeve for retaining the electrical contact within the interior chamber of the housing.

15. The electrical connector according to claim 11, wherein the contact channel of the dielectric insert extends along a central longitudinal axis, the free ends of the resilient fingers comprising a locked position and being movable from the locked position radially outward relative to the central longitudinal axis of the contact channel, the free ends of the resilient fingers being engaged with the sleeve of the terminating segment of the electrical contact when in the locked position.

16. The electrical connector according to claim 11, wherein the interior chamber of the housing comprises a mating cavity and a mounting cavity, the mounting cavity having a bottom, an opening extends through the bottom such that the mating and mounting cavities fluidly communicate with each other, the dielectric insert and the terminating segment of the electrical contact being held within the mounting cavity of the interior chamber, the mating segment of the electrical contact extending through the opening into the mating cavity of the interior chamber.

* * * * *

UNITED STATES PATENT AND TRADEMARK OFFICE

CERTIFICATE OF CORRECTION

PATENT NO. : 7,887,368 B1
APPLICATION NO. : 12/510904
DATED : February 15, 2011
INVENTOR(S) : Jared Evan Rossman, Steven Lee Flickinger and Phillip Clay Brandberg It is certified that error appears in the above-identified patent and that said Letters Patent is hereby corrected as shown below:

Title Page, Item (75)

Correct spelling of inventor's last name:

Steven Lee Flickinger

Signed and Sealed this
Twelfth Day of April, 2011

David J. Kappos

David J. Kappos
*Director of the United States Patent and Trademark Office*